US007867419B2

(12) United States Patent
Ohira et al.

(10) Patent No.: US 7,867,419 B2
(45) Date of Patent: Jan. 11, 2011

(54) METHOD FOR PREPARING GOLF BALL AND GOLF BALL

(75) Inventors: Takashi Ohira, Chichibu (JP); Shinichi Hinomoto, Chichibu (JP); Junji Umezawa, Chichibu (JP); Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 413 days.

(21) Appl. No.: 11/947,190

(22) Filed: Nov. 29, 2007

(65) Prior Publication Data

US 2009/0143170 A1 Jun. 4, 2009

(51) Int. Cl.
*A63B 37/00* (2006.01)
*B29C 39/12* (2006.01)
*B29C 45/16* (2006.01)

(52) U.S. Cl. ..... 264/135; 264/134; 264/265; 264/279.1; 156/153; 156/244.23; 156/245; 427/207.1; 427/214; 427/301; 427/302; 473/377

(58) Field of Classification Search ..... None
See application file for complete search history.

(56) References Cited

U.S. PATENT DOCUMENTS

| | | | | | |
|---|---|---|---|---|---|
| 3,972,973 | A * | 8/1976 | Yardley et al. | ..... | 264/265 |
| 4,300,970 | A * | 11/1981 | Honda et al. | ..... | 156/244.11 |
| 5,100,704 | A * | 3/1992 | Iwakura et al. | ..... | 427/302 |
| 6,183,382 | B1 * | 2/2001 | Kim et al. | ..... | 473/374 |
| 6,315,915 | B1 * | 11/2001 | Hebert et al. | ..... | 216/67 |
| 2003/0104880 | A1 * | 6/2003 | Fushihara | ..... | 473/378 |
| 2005/0004325 | A1 * | 1/2005 | Wu et al. | ..... | 525/462 |
| 2005/0245652 | A1 * | 11/2005 | Bulpett et al. | ..... | 524/289 |

FOREIGN PATENT DOCUMENTS

| | | | |
|---|---|---|---|
| GB | 1293842 | * | 10/1972 |
| JP | 02117829 | * | 5/1990 |
| JP | 05-317459 | A | 12/1993 |
| JP | 07-268132 | A | 10/1995 |
| JP | 07268005 | * | 10/1995 |
| JP | 10-219053 | A | 8/1998 |
| JP | 11-035633 | A | 2/1999 |
| JP | 11-104273 | A | 4/1999 |
| JP | 11-253581 | A | 9/1999 |
| JP | 2002-293996 | A | 10/2002 |
| JP | 2003-253201 | A | 9/2003 |

* cited by examiner

*Primary Examiner*—David Buttner
(74) *Attorney, Agent, or Firm*—Sughrue Mion, PLLC

(57) ABSTRACT

The present invention provides a method of manufacturing a golf ball having a solid core formed of a rubber composition and a cover of at least one layer encasing the core, which method includes the steps of treating a surface of the core with a solution containing a halogenated isocyanuric acid and/or a metal salt thereof, and covering the treated core with a cover material. The invention also provides a golf ball obtained by such a method. Golf balls obtained by this method have a good feel and a good scuff resistance, and also have a high durability to impact.

9 Claims, No Drawings

METHOD FOR PREPARING GOLF BALL AND GOLF BALL

BACKGROUND OF THE INVENTION

The present invention relates to a method of manufacturing golf balls having a good durability to impact, a soft feel, and a cover with excellent scuff resistance. The invention also relates to golf balls obtained by such a manufacturing method.

Conventional golf balls generally have a core which consists primarily of a diene rubber and a cover structure which is obtained by injection-molding a material made primarily of an ionomer resin over the core. In recent years, attempts have been made to use resin materials other than ionomer resins as the cover material in order to improve the feel of the ball on impact and the scuff resistance on approach shots.

For example, JP-A 11-104273 discloses a solid golf ball having a multilayer structure composed of a solid core and a two-layer cover encasing the core. The outer cover layer is composed primarily of a thermoplastic polyurethane elastomer. JP-A 10-219053 discloses the use of a polyamide elastomer as one component of a cover material for golf balls.

These golf balls have a good feel and a high scuff resistance. However, compared with ionomer resins, the cover material has an inferior compatibility with the diene rubber serving as the primary component of the core. As a result, on repeated impact, laminar separation tends to arise between the core surface and the adjoining cover layer.

In the golf ball industry, plasma treatment or corona discharge treatment is sometimes carried out as a means of increasing the adherence of, for example, a coat of paint. However, when such treatment is used to improve adhesion between the core surface and the adjoining cover layer, because the functional groups introduced by such treatment are relatively small groups such as hydroxyl groups or carboxyl groups, and because these functional groups are introduced onto a soft rubber surface, when the molten, high-temperature cover resin covers the core surface during injection molding, most of the functional groups thus introduced end up migrating from the core surface to the core interior, making it impossible to achieve the expected adhesion-improving effects. JP-A 5-317459 discloses the treatment of the core surface with an aqueous solution containing active chlorine (e.g., chlorine, concentrated hydrochloric acid, metal salts of hypochlorous acid), but such solutions are difficult to handle and bad for the environment, in addition to which they are not as effective as the aforementioned plasma treatment.

Another approach involves, as described in JP-A 11-253581, primer treatment in which a solution containing as a key ingredient a hot-melt resin is coated onto the surface to which the cover material is to be bonded. However, the high-temperature molten resin that flows over the core surface during injection molding dissolves and carries away the hot-melt resin serving as an ingredient in the primer, causing undesirable effects such as bleed-through to the parting line, which may adversely affect the durability and external appearance of the ball.

When the cover layer is formed by a heat compression molding or cast molding process using a thermoset polyurethane resin, the isocyanate included as an ingredient in the cover reacts with active hydrogen-containing functional groups derived from unsaturated carboxylic acids and/or metal salts thereof present in small amounts on the core surface. While this does improve adhesion with the core surface somewhat, the reaction takes too much time. As a result, this method has a far lower productivity than injection molding.

Accordingly, given the desire that exists for golf balls which are also endowed with a good feel and a good scuff resistance, there remains room for improvement in achieving a high durability to impact.

SUMMARY OF THE INVENTION

It is therefore an object of the present invention to provide a method of manufacturing golf balls which, in addition to having a good feel on impact and a good scuff resistance, are also endowed with a high durability to impact. Another object of the invention is to provide golf balls obtained by such a method.

The inventor has discovered that, in a method of manufacturing a multilayer golf ball having a solid core made of a base rubber and a cover of one or more layer which encloses the core, by treating the core surface with a solution containing a halogenated isocyanuric acid and/or a metal salt thereof, then covering the core with a cover material, adhesion between the core surface and the cover can be greatly improved, enabling a very high impact durability to be achieved. Moreover, by using here a cover material composed primarily of a urethane resin or a polyamide resin to form the cover, there can be obtained a solid golf ball having an outstanding feel and scuff resistance compared with prior-art golf balls.

Accordingly, the invention provides the following methods of manufacturing golf balls and the following golf balls.

[1] A method of manufacturing a golf ball having a solid core formed of a rubber composition and a cover of one or more layer encasing the core, comprising the steps of:

treating a surface of the core with a solution containing a halogenated isocyanuric acid and/or a metal salt thereof dissolved in a solvent, and covering the treated core with a cover material.

[2] The golf ball manufacturing method of [1], further comprising the step of abrading the core surface prior to treatment with the solution containing a halogenated isocyanuric acid and/or a metal salt thereof.

[3] The golf ball manufacturing method of [2], wherein said abrading is carried out by a method selected from the group consisting of buffing, barrel finishing and centerless grinding.

[4] The golf ball manufacturing method of [1], further comprising the step of, following treatment of the core surface with a solution containing a halogenated isocyanuric acid and/or a metal salt thereof, washing the core surface with water.

[5] The golf ball manufacturing method of [1], wherein the halogenated isocyanuric acid and/or a metal salt thereof is one or more selected from the group consisting of chloroisocyanuric acid, sodium chloroisocyanurate, potassium chloroisocyanurate, dichloroisocyanuric acid, sodium dichloroisocyanurate, potassium dichloroisocyanurate and trichloroisocyanuric acid.

[6] The golf ball manufacturing method of [1], wherein the core is composed primarily of a diene rubber.

[7] The golf ball manufacturing method of [1], wherein the cover has a layer adjoining the core, which layer is made of one or more selected from the group consisting of thermoplastic polyurethane elastomers, thermoset polyurethane resins and polyamide elastomers.

[8] The golf ball manufacturing method of [1], wherein treatment of the core surface with a solution containing a halogenated isocyanuric acid and/or a metal salt thereof is carried out by an immersion method.

[9] The golf ball manufacturing method of [8], wherein immersion is carried out for a period of from 0.3 second to 5 minutes.

[10] The golf ball manufacturing method of [1], wherein the solvent in the solution containing a halogenated isocyanuric acid and/or a metal salt thereof is acetone.

[11] The golf ball manufacturing method of [1], wherein the halogenated isocyanuric acid and/or a metal salt thereof is included in the solution in an amount of from 0.3 to 10 wt %.

[12] A method of manufacturing a golf ball having a solid core formed of a rubber composition comprising a diene rubber and a cover of one or more layer encasing the core, comprising the steps of, in order:

abrading a surface of the core, immersing the abraded core in a solution containing a halogenated isocyanuric acid and/or a metal salt thereof, rinsing the core with water, drying the core, and covering the core with, as the cover, at least one type of elastomer selected from the group consisting of polyurethane elastomers and polyamide elastomers.

[13] The golf ball manufacturing method of [12], wherein said covering step is carried out by injection molding the elastomer over the core.

[14] A golf ball having a solid core formed of a rubber composition and a cover of one or more layer encasing the core, wherein a cover layer adjoining the core is formed primarily of a thermoplastic polymer material having a molecular structure with mutually neighboring amino groups and carbonyl groups, and wherein substituents having a molecular structure with mutually neighboring amino groups and carbonyl groups are introduced onto a surface of the core.

[15] The golf ball of [14], wherein the cover layer adjoining the core is formed primarily of at least one elastomer selected from the group consisting of polyurethane elastomers and polyamide elastomers.

[16] The golf ball of [14], wherein the substituents are introduced onto the core surface by using a halogenated isocyanuric acid and/or a metal salt thereof.

DETAILED DESCRIPTION OF THE INVENTION

The invention is described more fully below.

The golf ball of the invention has a solid core and a cover of one or more layer encasing the core.

The solid core in the present invention is preferably formed of a rubber composition which includes the following components:

(A) a base rubber containing from 60 to 100 wt % of a polybutadiene having a cis-1,4 bond content of at least 60%, (B) an organic peroxide, (C) an unsaturated carboxylic acid and/or a metal salt thereof, and (E) an inorganic filler.

In addition, (D) an organosulfur compound may also be included where necessary.

In above component A, which is a base rubber containing from 60 to 100 wt % of a polybutadiene having a cis-1,4 bond content of at least 60%, the cis-1,4 bond content in the polybutadiene is at least 60%, preferably at least 80%, more preferably at least 90%, and even more preferably at least 95%. At a cis-1,4 bond content in the polybutadiene of less than 60%, a good rebound may not be achieved. The molecular weight distribution $M_w/M_n$ (where $M_w$ is the weight-average molecular weight, and $M_n$ is the number-average molecular weight) is at least 2.0, preferably at least 2.2, more preferably at least 2.4, and most preferably at least 2.6, but not more than 8.0, preferably not more than 7.5, even more preferably not more than 4.0, and most preferably not more than 3.4. At too small a molecular weight distribution $M_w/M_n$, the workability may decrease. On the other hand, if $M_w/M_n$ is too large, the rebound may decrease.

The polybutadiene in the invention is not subject to any particular limitation, although the use of a polybutadiene synthesized with a rare-earth catalyst is preferred for achieving a high rebound. A known rare-earth catalyst may be used for this purpose. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

The above-mentioned organoaluminum compound may be, for example, a compound of the formula $AlR^1R^2R^3$ (wherein $R^1$, $R^2$ and $R^3$ are each independently a hydrogen atom or a hydrocarbon residue of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are acceptable.

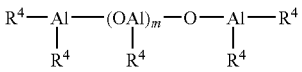

(I)

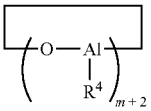

(II)

In formulas I and II, $R^4$ is a hydrocarbon group having from 1 to 20 carbon atoms, and m is an integer of 2 or more.

Examples of the halogen-bearing compound include aluminum halides of the general formula $AlX_nR_{3-n}$ (wherein X is a halogen atom; R is a hydrocarbon residue of from 1 to 20 carbons, such as an alkyl, aryl or aralkyl group; and n is 1, 1.5, 2 or 3); strontium halides such as $Me_3SrCl$, $Me_2SrCl_2$, $MeSrHCl_2$ and $MeSrCl_3$ (where "Me" stands for a methyl group); and also metal halides such as silicon tetrachloride, tin tetrachloride, and titanium tetrachloride.

The Lewis base may be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Preferred examples of such rare-earth catalysts include those mentioned in JP-A 11-35633.

When the butadiene is polymerized in the presence of a rare-earth catalyst which uses a lanthanide series rare-earth compound, in order to have the cis bond content and the molecular weight distribution $M_w/M_n$ (where $M_w$ is the weight-average molecular weight, and $M_n$ is the number-average molecular weight) fall within the above range, the molar ratio of the butadiene to the lanthanide series rare-earth compound (butadiene/lanthanide series rare-earth compound) is preferably from 1,000 to 2,000,000, and more preferably from 5,000 to 1,000,000; and the molar ratio of $AlR^1R^2R^3$ to the lanthanide series rare-earth compound ($AlR^1R^2R^3$/lanthanide series rare-earth compound) is preferably from 1 to 1,000, and more preferably from 3 to 500. Also, the molar ratio of the halogen-bearing compound to the lanthanide series rare-earth compound (halogen-bearing compound/lanthanide series rare-earth compound) is preferably from 0.1 to 30, and more preferably from 0.2 to 15. The molar ratio of the Lewis base to the lanthanide series rare-earth compound (Lewis base/lanthanide series rare-earth compound) is preferably from 0 to 30, and more preferably from 1 to 10. Polymerization may be carried out by bulk polymerization or vapor-phase polymerization, with or without the use of a solvent. The polymerization temperature is generally from −30 to 150° C., and preferably from 10 to 100° C.

The polybutadiene used in the present invention has a Mooney viscosity ($ML_{1+4}$ (100° C.)) of preferably at least 20, more preferably at least 30, and even more preferably at least 40, but preferably not more than 140, more preferably not more than 120, even more preferably not more than 100, and most preferably not more than 80. At a Mooney viscosity outside of the above range, the workability may worsen and the rebound may decrease.

The term "Mooney viscosity" used herein refers to an industrial indicator of viscosity as measured with a Mooney viscometer, which is a type of rotary plastometer (JIS-K6300). The unit symbol used is $ML_{1+4}$ (100° C.), where "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

The above-described polybutadiene used in the present invention may be obtained by polymerization using the above-described rare-earth catalyst, followed by the reaction of an active end on the polymer with a terminal modifier.

A known terminal modifier may be used for this purpose. Illustrative examples include compounds of types (1) to (7) below.

(1) One type of suitable terminal modifier includes alkoxysilyl group-bearing compounds. Alkoxysilyl group-bearing compounds that are preferable for use include alkoxysilane compounds having at least one epoxy group or isocyanate group on the molecule. Specific examples include epoxy group-bearing alkoxysilanes such as 3-glycidyloxypropyltrimethoxysilane, 3-glycidyloxypropyltriethoxysilane, (3-glycidyloxypropyl)methyldimethoxysilane, (3-glycidyloxypropyl)methyldiethoxysilane, β-(3,4-epoxycyclohexyl)trimethoxysilane, β-(3,4-epoxycyclohexyl)triethoxysilane, β-(3,4-epoxycyclohexyl)methyldimethoxysilane, β-(3,4-epoxycyclohexyl)ethyldimethoxysilane, condensation products of 3-glycidyloxypropyltrimethoxysilane, and condensation products of (3-glycidyloxypropyl)methyldimethoxysilane; and isocyanate group-bearing alkoxysilane compounds such as 3-isocyanatopropyltrimethoxysilane, 3-isocyanatopropyltriethoxysilane, (3-isocyanatopropyl)methyldimethoxysilane, (3-isocyanatopropyl)methyldiethoxysilane, condensation products of 3-isocyanatopropyltrimethoxysilane, and condensation products of (3-isocyanatopropyl)methyldimethoxysilane.

When the above alkoxysilyl group-bearing compounds are reacted with an active end on the polymer, a Lewis acid may be added to promote the reaction. The Lewis acid acts as a catalyst, promoting the coupling reaction, as a result of which the modified polymer is less subject to cold flow, giving the polymer a good storage stability. Illustrative examples of Lewis acids include dialkyltin dialkyl malates, dialkyltin dicarboxylates and aluminum trialkoxides.

(2) Halogenated organometallic compounds, halogenated metallic compounds and ester or carbonyl group-bearing organometallic compounds of the general formulas $R^5_pM'X_{4-p}$, $M'X_4$, $M'X_3$, $R^5_pM'(—R^6—COOR^7)_{4-p}$ or $R^5_pM'(—R^6—COR^7)_{4-p}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and p is an integer from 0 to 3);

(3) heterocumulene compounds having on the molecule a Y═C═Z linkage (wherein Y is a carbon, oxygen, nitrogen or sulfur atom; and Z is an oxygen, nitrogen or sulfur atom);

(4) three-membered heterocyclic compounds containing on the molecule a bond of the following formula (III)

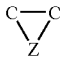

(wherein Z is an oxygen, nitrogen or sulfur atom);

(5) halogenated isocyano compounds;

(6) carboxylic acids, acid halides, ester compounds, carbonate compounds and acid anhydrides of the formula $R^8—(COOH)_q$, $R^9(COX)_q$, $R^{10}—(COO—R^{11})_q$, $R^{12}—OCOO—R^{13}$, $R^{14}—(COOCO—R^{15})_q$ or the following formula (IV)

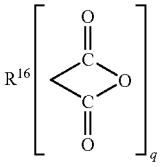

(wherein $R^8$ to $R^{16}$ are each independently a hydrocarbon group of 1 to 50 carbons, X is a halogen atom, and q is an integer from 1 to 5); and (7) carboxylic acid metal salts of the formula $R^{17}_rM''(OCOR^{18})_{4-r}$, $R^{19}_rM''(OCO—R^{20}—COOR^{21})_{4-r}$ or the following formula (V)

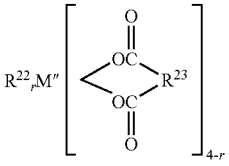

(wherein $R^{17}$ to $R^{23}$ are each independently a hydrocarbon group of 1 to 20 carbons, M" is a tin, silicon or germanium atom, and the letter r is an integer from 0 to 3).

Specific examples of the above terminal modifiers and methods for their reaction are described in, for example, JP-A 11-35633, JP-A 7-268132 and JP-A 2002-293996.

Of the above-mentioned catalysts, a rare-earth catalyst, particularly a neodymium catalyst, is preferred.

Above component A in the present invention is a base rubber composed primarily of a polybutadiene such as that described above. The content of polybutadiene serving as the main ingredient in the base rubber is at least 60 wt %, preferably at least 70 wt %, more preferably at least 80 wt %, and most preferably at least 85 wt %. The content of the above polybutadiene in the base rubber may be as high as 100 wt %, but is preferably 95 wt % or less, and more preferably 90 wt % or less. At a polybutadiene content of less than 60 wt %, the rebound may decline.

Rubber ingredients other than polybutadiene which may be included in above component A include, for example, styrene-butadiene rubbers, natural rubbers, isoprene rubbers and ethylene-propylene-diene rubbers, Rubber ingredients other than the above-described polybutadiene in the base rubber may account for the balance of the base rubber exclusive of the polybutadiene, and are included in an amount of preferably 40 wt % or less, more preferably 30 wt % or less, even more preferably 20 wt % or less, and most preferably at 15 wt % or less.

The organic peroxide serving as component B in the rubber composition making up the solid core is exemplified by dicumyl peroxide, 1,1-bis(t-butylperoxy)-3,5,5-trimethylcyclohexane and α,α'-bis(t-butylperoxy)diisopropylbenzene. These organic peroxides may be a commercial available products, examples of which include Percumyl D (produced by NOF Corporation), Perhexa 3M (NOF Corporation) and Luperco 231XL (Atochem Co.). These may be used singly or as combinations of two or more thereof.

The amount of the organic peroxide included per 100 parts (unless noted otherwise, "part" and "parts" refer here and below to parts by weight) of above component A is preferably at least 0.1 part, more preferably at least 0.2 part, and even more preferably at least 0.3 part, but preferably not more than 10 parts, more preferably not more than 5 parts, and even more preferably not more than 2 parts. If too little component B is included, the length of time required for crosslinking increases, which may result in a large decline in productivity and may also significantly lower the compression of the ball. If too much is included, the rebound and durability may decrease.

Next, in the unsaturated carboxylic acid and/or metal salt thereof serving as component C, the unsaturated carboxylic acid is exemplified by acrylic acid, methacrylic acid, maleic acid and fumaric acid. Acrylic acid and methacrylic acid are especially preferred. Metal salts of unsaturated carboxylic acids include zinc salts and magnesium salts. Of the above, the use of zinc acrylate is preferred.

The amount of component C included per 100 parts of component A is preferably at least 10 parts, more preferably at least 15 parts, and even more preferably at least 20 parts, but preferably not more than 60 parts, more preferably not more than 50 parts, even more preferably not more than 45 parts, and most preferably not more than 40 parts. At an amount of component C outside of the above range, the rebound of the ball may decrease and the feel on impact may worsen.

The organosulfur compound serving as component D in the rubber composition is an optional ingredient used to increase rebound. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, and zinc salts thereof; and diphenylpolysulfides, dibenzylpolysulfides, dibenzoylpolysulfides, dibenzothiazoylpolysulfides, dithiobenzoylpolysulfides, alkylphenyldisulfides, furan ring-bearing sulfur compounds and thiophene ring-bearing sulfur compounds having 2 to 4 sulfurs. Diphenyldisulfide and the zinc salt of pentachlorothiophenol are especially preferred.

The amount of component D included per 100 parts of component A is preferably at least 0.1 part, more preferably at least 0.2 part, even more preferably at least 0.4 part, and most preferably at least 0.7 part, but preferably not more than 10 parts, more preferably not more than 5 parts, and even more preferably not more than 3 parts. If too little component D is included, the rebound-enhancing effect may vanish. On the other hand, too much component D may excessively lower the hardness and make it impossible to achieve a sufficient rebound.

The inorganic filler serving as component E in the rubber composition making up the solid core is exemplified by zinc oxide, barium sulfate and calcium carbonate. The amount of component E included per 100 parts of component A is preferably at least 3 parts, more preferably at least 5 parts, and even more preferably at least 10 parts, but preferably not more than 80 parts, more preferably not more than 65 parts, and even more preferably not more than 50 parts. Too much or too little component E may make it impossible to achieve a suitable weight and a good rebound.

The rubber composition containing above components A to E may also include therein, if necessary, an antioxidant. The amount in which the antioxidant is added per 100 parts of component A is preferably at least 0.05 part, more preferably at least 0.1 part, and even more preferably at least 0.2 part, but preferably not more than 5 parts, more preferably not more than 3 parts, and even more preferably not more than 1 part. The antioxidant may be a commercially available product, illustrative examples of which include Nocrac NS-6 and Nocrac NS-30 (both produced by Ouchi Shinko Chemical Industry Co., Ltd.) and Yoshinox 425 (Yoshitomi Pharmaceutical Industries, Ltd.).

The solid core in the invention is thus formed of a rubber composition containing the above ingredients (although component D is an optional ingredient). The method used to form the core is preferably a method that involves vulcanizing and curing the rubber composition. Vulcanization may be carried out under, for example, the following conditions: a vulcanization temperature of 100 to 200° C., and a vulcanization time of from 10 to 40 minutes.

The local hardness of the solid core formed as described above may be suitably adjusted and is not subject to any particular limitation. For example, the solid core may be given a local hardness distribution in which the hardness from the center to the surface of the molded material is the same or in which there is a hardness difference from the center to the surface of the molded material.

The solid core has a diameter of preferably at least 35 mm, and more preferably at least 37 mm, but preferably not more than 42 mm, more preferably not more than 41 mm, and even more preferably not more than 40 mm. If the diameter of the solid core is too small, the feel on impact and the rebound may worsen. On the other hand, if the diameter is too large, the durability to cracking may worsen.

The solid core has a deflection, measured as the deformation when compressed under a final load of 1,275 N (130 kgf)

from an initial load state of 98 N (10 kgf), of preferably at least 2.0 mm, and more preferably at least 3.0 mm, but preferably not more than 5.5 mm, and more preferably not more than 5.0 mm. A deflection of less than 2.0 mm may worsen the feel of the ball on impact and, particularly on long shots such as with a driver in which the ball incurs a large deformation, may subject the ball to an excessive rise in spin, shortening the distance traveled by the ball. On the other hand, a deflection of more than 5.5 mm may deaden the feel of the ball when played and compromise the rebound of the ball, resulting in a shorter distance, and moreover may give the ball a poor durability to cracking on repeated impact.

It is recommended that the solid core have a specific gravity ($g/cm^3$) of preferably at least 0.9, more preferably at least 1.0, and even more preferably at least 1.1, but not more than 1.4, preferably not more than 1.3, and more preferably not more than 1.2.

In the present invention, the solid core is surface treated with a solution containing a halogenated isocyanuric acid and/or a metal salt thereof.

By subjecting the surface of the solid core to abrading treatment prior to surface treatment with the subsequently described solution containing a halogenated isocyanuric acid and/or a metal salt thereof, adhesion between the core surface and the adjoining cover material can be further enhanced.

Abrasion treatment at this time removes a skin layer from the surface of the vulcanized core, thereby increasing the ability of the solution of a halogenated isocyanuric acid and/or a metal salt thereof to penetrate the core surface and also increasing the surface area of contact with the adjoining cover material. Specific examples of suitable methods of abrasion include buffing, barrel finishing and centerless grinding.

The halogenated isocyanuric acid and metal salt thereof in the invention is a compound of the following formula (IV).

(VI)

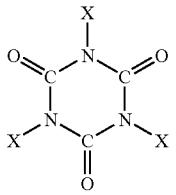

In the formula, X is a hydrogen atom, a halogen atom or an alkali metal atom, provided at least one occurrence of X is a halogen atom. Preferred halogen atoms are fluorine, chlorine and bromine, with chlorine being especially preferred. Preferred alkali metal atoms are lithium, sodium and potassium.

Specific examples of halogenated isocyanuric acid and/or metal salts thereof include chloroisocyanuric acid, sodium chloroisocyanurate, potassium chloroisocyanurate, dichloroisocyanuric acid, sodium dichloroisocyanurate, sodium dichloroisocyanurate dihydrate, potassium dichloroisocyanurate, trichloroisocyanuric acid, tribromoisocyanuric acid, dibromoisocyanuric acid, bromoisocyanuric acid, sodium and other salts of dibromoisocyanuric acid as well as hydrates thereof, and difluoroisocyanuric acid. Of these, chloroisocyanuric acid, sodium chloroisocyanurate, potassium chloroisocyanurate, dichloroisocyanuric acid, sodium dichloroisocyanurate, potassium dichlorisocyanurate and trichloroisocyanuric acid are preferred. The reason is that these are easily hydrolyzed by moisture to form acid and chlorine, and thus function as an initiator of addition reactions to the double bonds in the diene rubber molecule. The use of trichloroisocyanuric acid in particular has a pronounced adhesion improving effect.

In the practice of the invention, it is preferable to use a solution prepared by dissolving the halogenated isocyanuric acid and/or a metal salt thereof in an organic solvent. The organic solvent may be a known solvent, with the use of an organic solvent which is soluble in water being especially preferred. Specific examples of such organic solvents include ethyl acetate, acetone and methyl ethyl ketone. Of these, acetone is especially preferred because of its ability to penetrate the core surface. The use of a solvent which is soluble in water is preferred because it allows moisture to be easily taken up by the solvent; such moisture that has been taken up facilitates a hydrolysis reaction with the halogenated isocyanuric acid and/or a metal salt thereof adhering to the core surface. Another reason for the preferred use of such a solvent is that, when water washing is used as the next step, the solvent increases affinity to the core surface and allows a hydrolysis reaction between the water and the halogenated isocyanuric acid and/or a metal salt thereof to readily occur.

When dissolved in the organic solvent, the content of the halogenated isocyanuric acid and/or metal salt thereof in the solution is preferably at least 0.3 wt %, more preferably at least 1 wt %, and even more preferably at least 2.5 wt %. At less than 0.3 wt %, the expected adhesion improving effect following core surface treatment may not be achievable, which may result in a poor durability to impact. Any amount up to the saturated solution concentration may be used. However, from the standpoint of cost effectiveness, in the case of an acetone solution, for example, it is preferable to set the upper limit to a concentration of about 10 wt %. The length of time that the core is immersed in the above solution is preferably at least 0.3 second, more preferably at least 3 seconds, and even more preferably at least 10 seconds, but preferably not more than 5 minutes, more preferably not more than 1 minute, and even more preferably not more than 30 seconds. If the period of immersion is too short, the effects of treatment may not be obtained. On the other hand, a period of immersion that is too long may compromise the productivity.

The core surface may be treated with the halogenated isocyanuric acid and/or a metal salt thereof by, for example, brush coating or spraying a solution of the halogenated isocyanuric acid and/or a metal salt thereof onto the surface of the core, or by immersing the core in a solution of the halogenated isocyanuric acid and/or a metal salt thereof. To achieve a good productivity and high penetration of the core surface by the solution, the use of an immersion method is especially preferred.

In the present invention, after the solid core has been surface treated with a solution containing the halogenated isocyanuric acid and/or a metal salt thereof, it is preferable to wash the surface of the core with water. Washing the core surface with water may be carried out in any of various ways, including with running water, by spraying, or by soaking in a wash tank. However, because the aim here is not merely to wash, but also to initiate and promote the desired treatment reactions, a washing method that is too abrupt is inappropriate. Accordingly, in the present invention, the use of washing by soaking in a wash tank is preferred. In this case, it is preferable to place the core being treated from about one to about five times in a wash tank containing fresh water.

In the practice of the invention, adhesion with the cover is greatly enhanced by treating the core surface with the halogenated isocyanuric acid and/or a metal salt thereof. The reason, while not entirely clear, is thought to be as follows.

First, the halogenated isocyanuric acid and/or a metal salt thereof penetrates together with the solvent to the interior of the diene rubber which forms the core, approaching the vicinity of double bonds on the main chain. Next, water enters the core surface, whereupon the halogenated isocyanuric acid and/or a metal salt thereof is hydrolyzed by the water, releasing the halogen. The halogen attacks double bonds on the diene rubber main chain nearby, as a result of which an addition reaction proceeds. In the course of this addition reaction, the liberated isocyanuric acid is added to the diene rubber main chain together with the chlorine, with the cyclic structure remaining intact. The added isocyanuric acid has three —NHCO— structures on the molecule.

Because the core surface which has been treated with the halogenated isocyanuric acid and/or a metal salt thereof is furnished with —NHCO— structures, adhesion with the cover material is further enhanced, presumably improving the durability of the golf ball to impact. Moreover, by using as the cover material a polyurethane elastomer or a polyamide elastomer having the same —NHCO— structures on the polymer molecules, it is believed that the affinity is even further increased, resulting in a higher durability to impact.

When the addition of isocyanuric acid and chlorine to the surface of diene rubber has occurred, the change in the bond state before and after addition appears in the infrared absorption spectrum as increases in the absorption peak for C═O bonds (stretching) at 1725 to 1705 $cm^{-1}$, the broad absorption peak for N—H bonds (stretching) at 3450 to 3300 $cm^{-1}$, and the absorption peak for C–Cl bonds at 800 to 600 $cm^{-1}$. Hence, by measuring the infrared absorption spectrum for a surface-treated core and checking for increases in these absorption peaks, it is possible to qualitatively confirm that the addition of isocyanuric acid and chlorine to the diene rubber molecules has taken place.

Moreover, no exothermal or endothermal peaks are confirmed from room temperature to 300° C. in differential scanning calorimetry (DSC) on the material in the surface portions of surface-treated solid core. This fact signifies that, within this temperature range, the functional groups that have been introduced maintain a stable state. This means both that, during molding of the cover material, the functional groups which have been introduced do not incur decomposition and the like due to heat and thus retain their activity, and also that melting in the manner of hot melt resins does not occur, eliminating the need for concern over adverse effects on durability and external appearance of the golf ball owing to, for example, bleed-through to the parting line. Moreover, the fact that, as noted above, the material in the surface portion of the solid core following surface treatment is stable can also be regarded as proof that the isocyanuric acid, which has a melting point above 300° C., has been added with its molecular structure intact.

The cover employed in the invention is a material formed using as the primary ingredient at least one selected from among thermoplastic polyurethane elastomers, thermoset polyurethane resins and polyamide elastomers (which material is also referred to below simply as the "cover material").

These resins have in the resin skeleton the same —NHCO— molecular structure as isocyanuric acid, and firmly adhere by means of powerful intermolecular forces to the surface of the solid core treated as described above.

Polyurethane elastomers that may be used in the invention are not subject to any particular limitation, provided they are thermoplastic resins or thermoset resins composed primarily of polyurethane. A morphology composed of a high-molecular-weight polyol compound as the soft segments and a diisocyanate and a monomolecular chain extender as the hard segments is preferred.

First, the thermoplastic polyurethane elastomer is described. The high-molecular-weight polyol compound is not subject to any particular limitation and may be, for example, a polyester polyol or a polyether polyol. The use of a polyether polyol is preferred from the standpoint of rebound resilience or low-temperature properties.

Exemplary polyether polyols include polytetramethylene glycol and polypropylene glycol. Polytetramethylene glycol is especially preferred. These compounds have a number-average molecular weight of preferably at least 1,000, and more preferably at least 1,500, but preferably not more than 5,000, and more preferably not more than 3,000.

Examples of the diisocyanate include, but are not limited to, aromatic diisocyanates such as 4,4'-diphenylmethane diisocyanate, 2,4-toluene diisocyanate and 2,6-toluene diisocyanate; and aliphatic diisocyanates such as hexamethylene diisocyanate. In the present invention, for a good reaction stability with the subsequently described isocyanate mixture when blended therewith, the use of 4,4'-diphenylmethane diisocyanate is preferred.

The monomolecular chain extender, which is not subject to any particular limitation, may be an ordinary polyhydric alcohol or polyamine. Specific examples include 1,4-butylene glycol, 1,2-ethylene glycol, 1,3-propylene glycol, 1,3-butanediol, 1,6-hexylene glycol, 2,2-dimethyl-1,3-propanediol, 1,3-butylene glycol, dicyclohexylmethylmethanediamine (hydrogenated MDI) and isophoronediamine (IPDA). These chain extenders preferably have an average molecular weight of from 20 to 15,000.

A commercial product may be used as the above-described thermoplastic polyurethane elastomer. Illustrative examples include Pandex T7298, Pandex TR3080, Pandex T8190 and Pandex T8195 (all manufactured by DIC Bayer Polymer, Ltd.), and Resamine 2593 and Resamine 2597 (both manufactured by Dainichi Seika Colour & Chemicals Mfg. Co., Ltd.). These may be used alone or as combinations of two or more thereof.

Other ingredients such as pigments, dispersants, antioxidants, ultraviolet absorbers, ultraviolet stabilizers and plasticizers, and also inorganic fillers (e.g., zinc oxide, barium sulfate, titanium dioxide) may be optionally compounded with these thermoplastic polyurethane elastomers.

The amount in which such additives are included per 100 parts by weight of the thermoplastic polyurethane elastomer is preferably at least 0.1 part by weight, more preferably at least 0.5 part by weight, and even more preferably at least 1 part by weight, but preferably not more than 50 parts by weight, more preferably not more than 30 parts by weight, and even more preferably not more than 6 parts by weight. If the amount of such additives included is too high, the durability may decrease. On the other hand, if the amount of such additives included is too low, the desired effects of the additives may not be achieved.

The cover material has a Shore D hardness of preferably at least 40, and more preferably at least 50, but preferably not more than 70, and more preferably not more than 60. If the Shore D hardness is too low, the resilience may be poor. On the other hand, if the shore D hardness is too high, improvements in the feel and controllability of the ball may not be obtained. In the present invention, the Shore D hardness is the hardness measured with a type D durometer in accordance with ASTM D2240.

"Thermoset polyurethane resin cover" refers herein to a cover obtained by covering the surface of the core with a mixture containing the main ingredients of the above-described thermoplastic polyurethane elastomer prior to reaction, then applying heat to effect a reaction and curing on the core surface. This differs from the thermoplastic polyurethane elastomer in that the reaction increases the size of the polymer to a molecular weight at which the polymer does not have a melting point.

Other ingredients such as pigments, dispersants, antioxidants, ultraviolet absorbers, ultraviolet stabilizers and plasticizers, and also inorganic fillers (e.g., zinc oxide, barium sulfate, titanium dioxide) and curing accelerators may be optionally compounded with these thermoset polyurethane elastomers.

The amount in which such additives are included per 100 parts by weight of the thermoset polyurethane elastomer is preferably at least 0.1 part by weight, more preferably at least 0.5 part by weight, and even more preferably at least 1 part by weight, but preferably not more than 50 parts by weight, more preferably not more than 30 parts by weight, and even more preferably not more than 6 parts by weight. If the amount of such additives included is too high, the durability may decrease. On the other hand, if the amount of such additives included is too low, the desired effects of the additives may not be achieved.

The polyamide elastomers are not subject to any particular limitation, provided they are thermoplastic resins having a polyamide ingredient on the molecule. Such polyamide elastomers are characterized by having a higher rebound resilience the lower their hardness, and are therefore very well-suited for achieving a softer cover material on golf balls and for designing high-rebound golf balls.

The polyamide elastomer used may be a block copolymer which contains as the hard segments a polyamide component such as nylon 6, nylon 66, nylon 11, nylon 12 or an aromatic polyamide; and which contains as the soft segments a polyoxyalkylene glycol such as polyoxytetramethylene glycol or polyoxypropylene glycol, or an aliphatic polyester.

The above cover material has a Shore D hardness of preferably at least 20, and more preferably at least 40, but preferably not more than 70, and more preferably not more than 60. If the Shore D hardness is too low, this means that the content of the polyamide component serving as the hard segments is low, which results in a poor compatibility with the modified core surface and may lower the adhesive strength between the layers. If the Shore D hardness is too high, a good feel and improved controllability may not be achieved. As used herein, "Shore D hardness" is the hardness measured with a type D durometer in accordance with ASTM D2240.

Commercially available products that may be used as this polyamide elastomer include Pebax 2533, Pebax 3533 and Pebax 4033 produced by Arkema, Daiamid PAE E40 and Daiamid PAE E47 produced by Daicel Fuels, Grilon and Grilamid produced by EMS-Japan, Grilux produced by Dainippon Ink and Chemicals, Inc., Novamid EL produced by Mitsubishi Chemical Corporation, and Ube-PAE produced by Ube Industries, Ltd.

Other ingredients such as pigments, dispersants, antioxidants, ultraviolet absorbers, ultraviolet stabilizers and plasticizers, and also inorganic fillers (e.g., zinc oxide, barium sulfate, titanium dioxide) may be optionally compounded with these polyamide elastomers.

The amount in which such additives are included per 100 parts by weight of the polyamide elastomer is preferably at least 0.1 part by weight, more preferably at least 0.5 part by weight, and even more preferably at least 1 part by weight, but preferably not more than 50 parts by weight, more preferably not more than 30 parts by weight, and even more preferably not more than 6 parts by weight. If the amount of such additives included is too high, the durability may decrease. On the other hand, if the amount of such additives included is too low, the desired effects of the additives may not be achieved.

The above-described cover material exhibits a very good scuff resistance and achieves a good feel on impact.

The golf ball of the invention is a golf ball in which the cover layer adjoining the above-described core is formed of the above-described cover material. The inventive golf ball may be a solid two-piece golf ball composed of a solid core that has been surface treated with a solution of an isocyanuric acid and/or a metal salt thereof, which core is covered only with the above-described cover material. Alternatively, the inventive golf ball may be a multilayer solid golf ball having a cover of two or more layers on the core surface, which ball is obtained by using the above-described cover material to form an inner cover layer over the core surface, then covering the outside of the inner cover layer with at least one layer of another cover material as an outer cover layer.

The other cover material is not subject to any particular limitation, and may be any known material that is used as a cover material in golf balls. Illustrative examples include ionomer resins, polyester elastomers, polyurethane elastomers and polyamide elastomers having different physical properties than the polyurethane elastomer and the polyamide elastomer used in the inner cover layer, polyolefin elastomers, and mixtures thereof.

The method used to form the cover may be a known method and is not subject to any particular limitation. For example, use may be made of a method in which a prefabricated core is placed in a mold, and the cover material is melted under applied heat or mixed and melted under applied heat, then injection molded over the core.

Alternatively, a method may be used in which a pair of hemispherical half-cups are molded from the cover material, following which the half-cups are placed around the core and molded under applied pressure at 120 to 170° C. for 1 to 5 minutes. When a thermoset resin is used, a process such as RIM molding or LIM molding may be employed.

In particular, when the above-described cover material is formed by melting and injection molding, to ensure a flowability that is particularly suitable for injection molding and thus improving the moldability, it is desirable to adjust the melt flow rate. It is recommended that the melt flow rate (MFR) measured at a test temperature of 190° C. and under a test load of 21.18 N (2.16 kgf) in accordance with JIS-K6760 be generally at least 0.5 dg/min, preferably at least 1 dg/min, more preferably at least 1.5 dg/min, and even more preferably at least 2 dg/min, but generally not more than 20 dg/min, preferably not more than 10 dg/min, more preferably not more than 5 dg/min, and even more preferably not more than 3 dg/min. If the above melt flow rate is too high or too low, the moldability may be markedly lower.

The cover formed of the above cover material has a thickness of preferably at least 0.5 mm, and more preferably at least 1.0 mm, but preferably not more than 4.0, and more preferably not more than 2.5 mm. If the cover thickness is too high, the rebound may decrease. On the other hand, if the cover thickness is too low, the durability may decline.

In the golf ball obtained by the inventive manufacturing method, it is desirable to form a plurality of dimples on the surface of the cover, and to subject the cover to various treatments, such as surface preparation, stamping and painting. Concerning the arrangement of the dimples, it is desirable for the dimples to be arranged in such a way that the surface of the ball has not even a single great circle thereon which does not intersect with a dimple. The presence of a great circle which does not intersect with a dimple may give rise to variability in the distance traveled by the ball.

The above dimples are preferably optimized as to the number of dimple types and the total number of dimples. The synergistic effects achieved by optimizing the number of dimples types and the total number of dimples further stabilize the trajectory of the ball, making it possible to obtain a golf ball having an excellent distance performance.

"Number of dimple types" refers herein to the number of dimple types of mutually differing diameter and/or depth. It is recommended that the number of dimple types be preferably at least two, and more preferably at least three, but preferably not more than eight, and more preferably not more than six.

It is recommended that the total number of dimples be preferably at least 250, and more preferably at least 300, but preferably not more than 500, and more preferably not more than 455. If the total number of dimples is too low or too high, an optimal lift may not be achieved, which may shorten the distance traveled by the ball.

In the practice of the invention, when carrying out the above-mentioned painting, it is preferable to use the golf ball paint composition disclosed in JP-A 10-234884, i.e., a paint composition containing a hydroxyl group-bearing polyester obtained by reacting a polyol component with a polybasic acid component and containing also a non-yellowing polyisocyanate, wherein at least some portion of the polyol component has an alicyclic structure in the molecule; or the golf ball paint composition disclosed in JP-A 2003-253201, i.e., a paint composition containing a polyester and/or polyether-containing acrylic polyol having a hydroxyl value of from 30 to 180 mg KOH/g (solids) in combination with a polyisocyanate, wherein the acrylic polyol component has a main chain composed of an acrylic polymer and side chains composed of a polyester and/or a polyether, and wherein the molar ratio [NCO]/[OH] of isocyanate groups to hydroxyl groups is from 0.5 to 1.5. Because such paint compositions have an excellent cohesive failure strength, they are endowed with an impact resistance that withstands repeated impact with a golf club, an abrasion resistance that withstands bunker shots, an excellent resistance to grass staining, and outstanding weatherability and water resistance. Such paint compositions have been found to be capable of adhering well to the golf ball cover layer in the present invention.

The multilayer solid golf balls of the invention, which can be manufactured so as to conform with the Rules of Golf for competitive play, may be produced to a ball diameter which is not less than 42.67 mm. It is advantageous for the golf ball to have a weight of not less than 45.0 g, preferably not less than 45.2 g, and more preferably not less than 45.93 g.

The multilayer solid golf ball of the invention has the above-described core and the above-described cover, and preferably has numerous dimples on the surface of the cover. The deflection by the ball as a whole, measured as the deformation when compressed under a final load of 1,275 N (130 kgf) from an initial load state of 98 N (10 kgf), is preferably at least 2.0 mm, and more preferably at least 3.0 mm, but preferably not more than 5.0 mm, and more preferably not more than 4.5 mm. If the deflection is too small, the ball may have a poor feel and, particularly on long shots such as with a driver in which the ball incurs a large deformation, may subject the ball to an excessive rise in spin, shortening the distance traveled by the ball. On the other hand, a deflection which is too large may deaden the feel of the ball when played and compromise the rebound of the ball, resulting in a shorter distance, and may give the ball a poor durability to cracking with repeated impact.

EXAMPLES

The following Examples of the invention and Comparative Examples illustrate but do not limit the invention.

Examples 1 to 11

Comparative Examples 1 to 4

Solid cores were produced by vulcanizing the rubber compositions shown in Table 1 at 155° C. for 17 minutes. The solid cores were then treated under the conditions shown in Tables 3 and 4. Next, the surface-treated solid cores were immersed for 5 minutes in a water tank containing a sufficient volume of water, following which the cores were placed in fresh water and similarly immersed another three times. The cores were then removed and dried at room temperature.

TABLE 1

| Ingredients | | Amount included (pbw) |
|---|---|---|
| Base rubber | HCBN-13 | 100.0 |
| Organic peroxides | Perhexa 3M-40 | 0.3 |
| | Percumyl D | 0.3 |
| Metal salt of unsaturated carboxylic acid | Zinc acrylate | 28.4 |
| Organosulfur compound | Zinc salt of pentachlorothiophenol | 1.0 |
| Inorganic filler | Zinc oxide | 12.0 |
| Antioxidant | Nocrac NS-6 | 0.1 |

Further details on the above formulations are provided below.

HCBN-13: Available from JSR; cis-1,4-bond content, 96%; Mooney viscosity ($ML_{1+4}$ (100° C.)), 53; molecular weight distribution $M_w/M_n$, 3.2; neodymium catalyst.

Perhexa 3M-40: Available from NOF Corporation. Perhexa 3M-40 is a 40% dilution. The amount of addition indicated is the actual amount of 1,1-bis(t-butylperoxy)-3,3,5-trimethylcyclohexane added.

Percumyl D: Dicumyl peroxide; available from NOF Corporation.

Zinc acrylate: Available from Nihon Jyoryu Kogyo Co., Ltd.

Zinc salt of pentachlorothiophenol: Available from Tokyo Kasei Kogyo Co., Ltd.

Zinc oxide: Available from Sakai Chemical Industry Co., Ltd.

Nocrac NS-6: 2,2-Methylenebis(4-methyl-6-t-butylphenol); available from Ouchi Shinko Chemical Industry Co., Ltd.

When the addition of isocyanuric acid and chlorine to the diene rubber surface occurred as a result of the above surface treatment, changes in the bond states before and after addition appeared in the infrared absorption spectrum as increases in the absorption peak for C=O bonds (stretching) at 1725 to 1705 $cm^{-1}$, the broad absorption peak for N—H bonds (stretching) at 3450 to 3300 $cm^{-1}$, and the absorption peak for C—Cl bonds at 800 to 600 $cm^{-1}$.

Infrared absorption spectra were measured for cores actually treated with trichloroisocyanuric acid and untreated cores. On comparing the absorption peaks, increases in the absorption peaks were observed in the predicted wavelength regions. This qualitatively confirmed that the addition of isocyanuric acid and chlorine to the diene rubber molecules occurred at the core surface.

The infrared absorption spectrum measurements were carried out under the following conditions.

Measurement of Infrared Absorption Spectra

Apparatus: FTIR-8100M, manufactured by Shimadzu Corporation.

Measurement was carried out after mounting a DuraSamplIR (SensIR Technologies) attachment for attenuated total reflection (ATR) spectroscopy.

Sample preparation entailed cutting off a piece of the treated core surface with a knife.

The piece thus obtained was placed under pressure with the treated side facing down on a diamond crystal serving as the measurement area of the attachment, and measurement was carried out over a wavelength range of 4000 to 650 $cm^{-1}$. The spectrum obtained represented the average of 40 scans (data correction was carried out using only ATR correction).

Next, the ingredients shown in Table 2 were mixed at 200° C. with a kneading-type twin-screw extruder, thereby giving a cover material in the form of pellets. The resulting cover material was injected into a mold in which the above-described solid core had been placed, thereby producing a solid two-piece golf ball.

TABLE 2

| Ingredient | Amount included (parts by weight) A | B |
|---|---|---|
| Pandex T8190 (47D) | 100.0 | |
| Pebax 4033 (42D) | | 100.0 |
| Titanium dioxide | 2.0 | 2.0 |

Further details on the above formulations are described below.

Pandex T8190: A thermoplastic polyurethane elastomer available from DIC Bayer Polymer, Ltd.

Pebax 4033: A thermoplastic polyamide elastomer available from Arkema.

The performances of the golf balls produced are shown in Tables 3 and 4.

TABLE 3

| | | Example 1 | 2 | 3 | 4 | 5 | 6 | 7 | 8 | 9 | 10 | 11 |
|---|---|---|---|---|---|---|---|---|---|---|---|---|
| Core | Diameter (mm) | 40.3 | 40.3 | 40.3 | 40.3 | 40.3 | 40.3 | 40.3 | 40.3 | 40.3 | 40.3 | 40.3 |
| | Deflection (mm) | 3.8 | 3.8 | 3.8 | 3.8 | 3.8 | 3.8 | 3.8 | 3.8 | 3.8 | 3.8 | 3.8 |
| Concentration of trichloroisocyanuric acid in acetone solution (wt %) | | 0.3 | 1.5 | 3.0 | 10.0 | 3.0 | 3.0 | 3.0 | 3.0 | 3.0 | 3.0 | 3.0 |
| Immersion time (s) | | 20 | 20 | 20 | 20 | 0.3 | 3 | 10 | 60 | 300 | 20 | 20 |
| Argon plasma treatment (s) | | — | — | — | — | — | — | — | — | — | — | — |
| Cover | Type | A | A | A | A | A | A | A | A | A | B | C |
| | Thickness (mm) | 1.2 | 1.2 | 1.2 | 1.2 | 1.2 | 1.2 | 1.2 | 1.2 | 1.2 | 1.2 | 1.2 |
| | Hardness | 47 | 47 | 47 | 47 | 47 | 47 | 47 | 47 | 47 | 42 | 42 |
| Ball diameter (mm) | | 42.7 | 42.7 | 42.7 | 42.7 | 42.7 | 42.7 | 42.7 | 42.7 | 42.7 | 42.7 | 42.7 |
| Feel | Driver | good | good | good | good | good | good | good | good | good | good | good |
| | Putter | good | good | good | good | good | good | good | good | good | good | good |
| Scuff resistance | | good | good | good | good | good | good | good | good | good | good | good |
| Durability to impact | | fair | good | good | good | fair | good | good | good | good | good | good |

A: Polyurethane elastomer

B: Polyamide elastomer

C: A material obtained by adding 2 parts by weight of titanium dioxide to 100 parts by weight of a blend of equal parts of liquid A and liquid B of High Cast 3400N (a casting urethane resin produced by H&K, Ltd.) was cast-molded over the surface of the core.

TABLE 4

| | | Comparative Example 1 | 2 | 3 | 4 |
|---|---|---|---|---|---|
| Core | Diameter (mm) | 40.3 | 40.3 | 40.3 | 40.3 |
| | Deflection (mm) | 3.8 | 3.8 | 3.8 | 3.8 |
| Concentration of trichloroisocyanuric acid in acetone solution (wt %) | | — | — | — | — |
| Immersion time (s) | | — | — | — | — |
| Argon plasma treatment (s) | | — | — | — | 30 |
| Cover | Type | A | B | C | A |
| | Thickness (mm) | 1.2 | 1.2 | 1.2 | 1.2 |
| | Hardness | 47 | 42 | 42 | 42 |
| Ball diameter (mm) | | 42.7 | 42.7 | 42.7 | 42.7 |
| Feel | Driver | good | good | good | good |
| | Putter | good | good | good | good |
| Scuff resistance | | good | good | good | good |
| Durability to impact | | NG | NG | NG | NG |

A: Polyurethane elastomer

B: Polyamide elastomer

C: A material obtained by adding 2 parts by weight of titanium dioxide to 100 parts by weight of a blend of equal parts of liquid A and liquid B of High Cast 3400N (a casting urethane resin produced by H&K, Ltd.) was cast-molded over the surface of the core.

Evaluation of Ball Properties

Core Diameter (mm):

The average of measured values obtained at five points on the surface.

Core Deflection (mm):

The deformation of the core when compressed under a final load of 1,275 N (130 kgf) from an initial load state of 98 N (10 kgf) was measured.

Cover Thickness (mm):

Computed as (ball diameter−core diameter)+2.

Cover Hardness:

The Shore D hardness measured in accordance with ASTM D-2240.

Ball Diameter (mm):

The average of measured values obtained at five points on non-dimple areas of the surface.

Feel:

The feel of each ball when hit with a driver (W#1) and a putter was rated according to the following criteria by five skilled amateur golfers. The most common rating for a ball was used as the rating for that ball.

Good: soft
Fair: ordinary
NG: hard

Scuff Resistance:

The golf balls were held at a temperature of 23° C. and hit at a head speed of 33 m/s using a pitching wedge mounted on a swing robot machine, after which damage from the impact was visually rated according to the following criteria.

Good: No damage, or damage so slight as to be of no concern whatsoever for further use of ball.
NG: Severe damage, such as surface fraying or dimple obliteration.

Durability to Impact:

Golf balls were examined for laminar separation between the core and the cover after the balls were made to repeatedly strike a steel plate of sufficient mass at a velocity of 40 m/s. Five balls of each type were used for measurement, and the results were rated according to the following criteria.

Good: Separation was not observed in any of the balls even after 500 shots.
Fair: Separation was observed in one or two of the five balls after less than 500 shots.
NG: Separation was observed in substantially all five balls after less than 500 shots.

The invention claimed is:

1. A method of manufacturing a golf ball having a solid core formed of a rubber composition and a cover of one or more layer encasing the core, comprising the steps of:

abrading the core surface carried out by a method selected from the group consisting of buffing, barrel finishing and centerless grinding immersing a surface of the core with a solution containing a halogenated isocyanuric acid and/or a metal salt thereof dissolved in a solvent for a period of from 0.3 second to 1 minute, washing the core surface with water, drying the core, and covering the treated core with a cover material, wherein the cover has a layer adjoining the core, which layer is made of one or more selected from the group consisting of thermoplastic polyurethane elastomers, thermoset polyurethane resins and polyamide elastomers.

2. The golf ball manufacturing method of claim 1, wherein the halogenated isocyanuric acid and/or a metal salt thereof is one or more selected from the group consisting of chloroisocyanuric acid, sodium chloroisocyanurate, potassium chloroisocyanurate, dichloroisocyanuric acid, sodium dichloroisocyanurate, potassium dichloroisocyanurate and trichloroisocyanuric acid.

3. The golf ball manufacturing method of claim 1, wherein the core is composed primarily of a diene rubber.

4. A method of manufacturing a golf ball having a solid core formed of a rubber composition and a cover of one or more layer encasing the core, comprising the steps of:

abrading the core surface carried out by a method selected from the group consisting of buffing, barrel finishing and centerless grinding immersing a surface of the core with a solution containing a halogenated isocyanuric acid and/or a metal salt thereof dissolved in a solvent for a period of from 0.3 second to 1 minute, washing the core surface with water, drying the core, and covering the treated core with a cover material, wherein the solvent in the solution containing a halogenated isocyanuric acid and/or a metal salt thereof is acetone.

5. The golf ball manufacturing method of claim 4, wherein the halogenated isocyanuric acid and/or a metal salt thereof is one or more selected from the group consisting of chloroisocyanuric acid, sodium chloroisocyanurate, potassium chloroisocyanurate, dichloroisocyanuric acid, sodium dichloroisocyanurate, potassium dichloroisocyanurate and trichloroisocyanuric acid.

6. The golf ball manufacturing method of claim 4, wherein the core is composed primarily of a diene rubber.

7. A method of manufacturing a golf ball having a solid core formed of a rubber composition and a cover of one or more layer encasing the core, comprising the steps of:

abrading the core surface carried out by a method selected from the group consisting of buffing, barrel finishing and centerless grinding immersing a surface of the core with a solution containing a halogenated isocyanuric acid and/or a metal salt thereof dissolved in a solvent for a period of from 0.3 second to 1 minute, washing the core surface with water, drying the core, and covering the treated core with a cover material, wherein the halogenated isocyanuric acid and/or a metal salt thereof is included in the solution in an amount of from 0.3 to 10 wt %.

8. The golf ball manufacturing method of claim 7, wherein the halogenated isocyanuric acid and/or a metal salt thereof is one or more selected from the group consisting of chloroisocyanuric acid, sodium chloroisocyanurate, potassium chloroisocyanurate, dichloroisocyanuric acid, sodium dichloroisocyanurate, potassium dichloroisocyanurate and trichloroisocyanuric acid.

9. The golf ball manufacturing method of claim 7, wherein the core is composed primarily of a diene rubber.

* * * * *